US009523220B2

(12) United States Patent
Park et al.

(10) Patent No.: US 9,523,220 B2
(45) Date of Patent: Dec. 20, 2016

(54) DOOR OUTSIDE HANDLE FOR VEHICLE

(71) Applicant: Hyundai Motor Company, Seoul (KR)

(72) Inventors: Hoo Sang Park, Hwaseong-si (KR); Jung Ho Han, Seoul (KR)

(73) Assignee: Hyundai Motor Company, Seoul (KR)

( * ) Notice: Subject to any disclaimer, the term of this patent is extended or adjusted under 35 U.S.C. 154(b) by 86 days.

(21) Appl. No.: 14/290,602

(22) Filed: May 29, 2014

(65) Prior Publication Data

US 2015/0167347 A1 Jun. 18, 2015

(30) Foreign Application Priority Data

Dec. 18, 2013 (KR) ..... 10-2013-0158755

(51) Int. Cl.
*E05B 3/00* (2006.01)
*E05B 85/16* (2014.01)
*E05B 15/00* (2006.01)

(52) U.S. Cl.
CPC ..... *E05B 85/16* (2013.01); *E05B 15/0093* (2013.01); *Y10T 16/458* (2015.01)

(58) Field of Classification Search
CPC .. E05B 77/06; Y10T 292/0908; Y10S 292/22; Y10S 292/65; B60J 5/0456
USPC ..... 292/336.3
See application file for complete search history.

(56) References Cited

U.S. PATENT DOCUMENTS

2003/0001399 A1* 1/2003 Sato ..... E05B 79/06 292/336.3

FOREIGN PATENT DOCUMENTS

| | | | |
|---|---|---|---|
| JP | 2003-13630 | A | 1/2003 |
| KR | 1020100060534 | A | 6/2010 |
| KR | 1020120047056 | A | 5/2012 |
| KR | 1020130060869 | A | 6/2013 |

* cited by examiner

*Primary Examiner* — Mark Williams
(74) *Attorney, Agent, or Firm* — Morgan, Lewis & Bockius LLP

(57) ABSTRACT

A door outside handle for vehicle may include a door handle which has a handle hinge formed at one end and a handle lever formed at the other end and has a lever groove formed on a lower end bottom surface of the handle lever, a handle base which has a hinge hole formed at one end and a lever hole formed at the other end into which the handle hinge and the handle lever are inserted, and has two shaft coupling portions separately formed at a position corresponding to where the lever hole is formed, and a balance weight which includes a balance shaft rotatably inserted into the shaft coupling portions and has an assembly protrusion formed to be fitted to the lever groove.

4 Claims, 10 Drawing Sheets

FIG. 2A (Related Art)
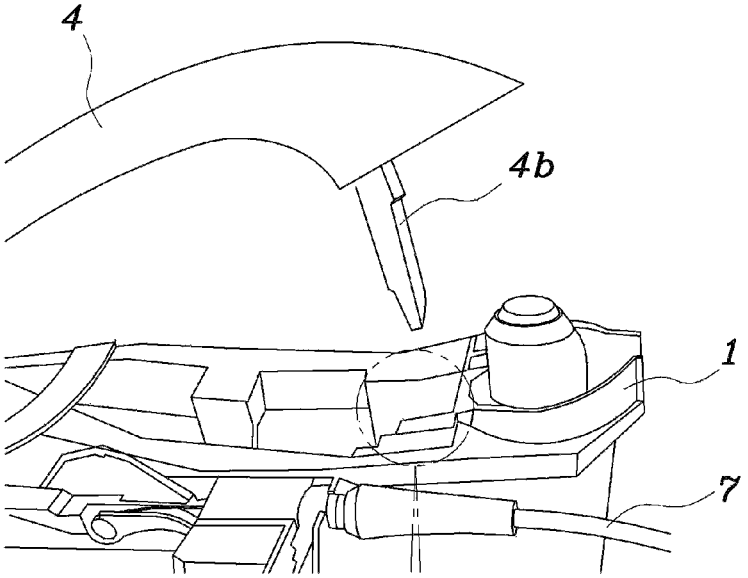
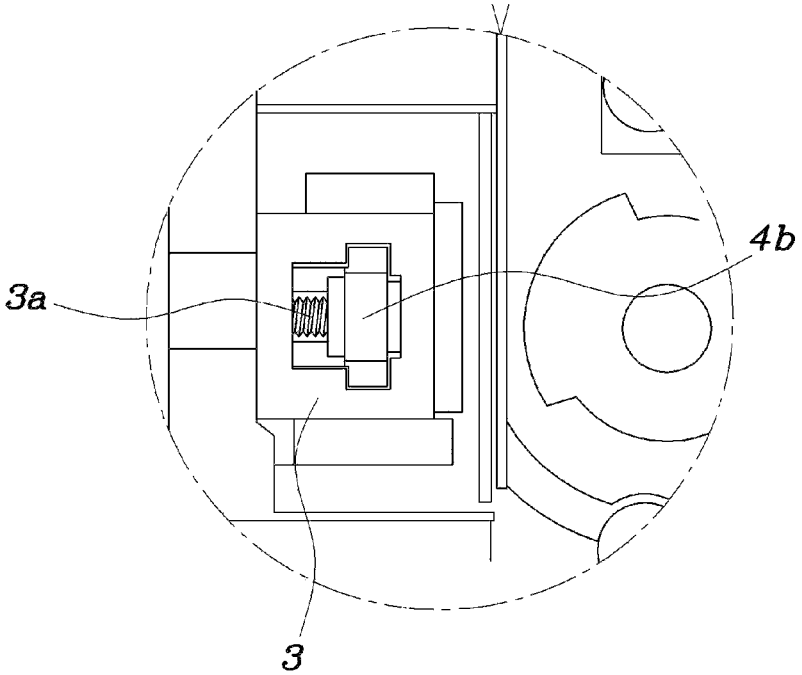
FIG. 2B (Related Art)

FIG. 9A
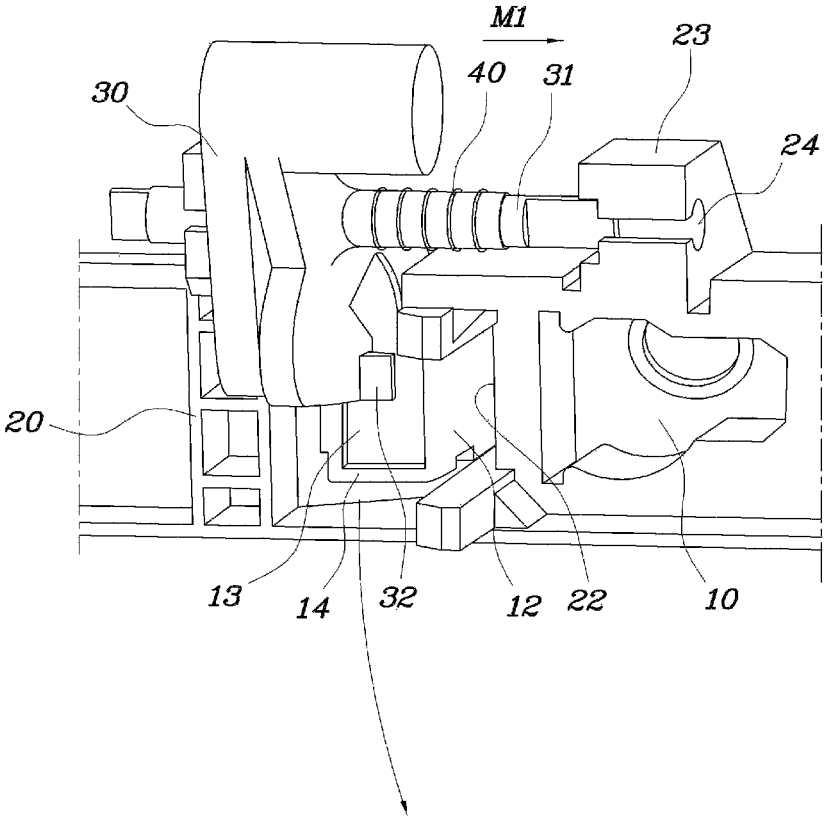
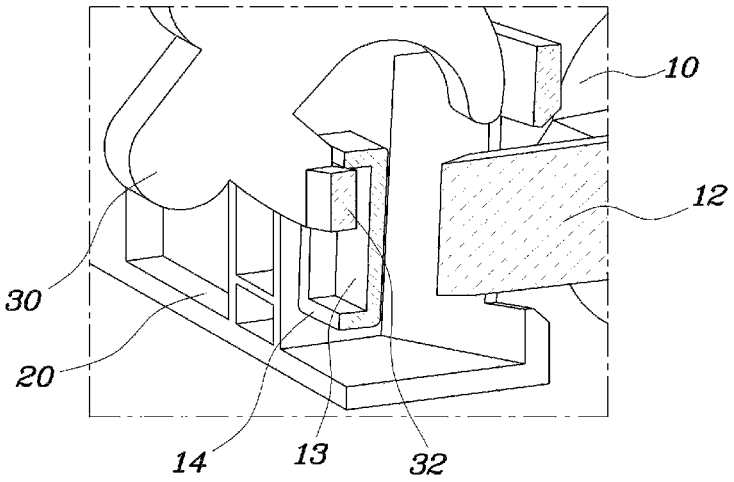
FIG. 9B

DOOR OUTSIDE HANDLE FOR VEHICLE

CROSS-REFERENCE TO RELATED APPLICATION

The present application claims priority of Korean Patent Application Number 10-2013-0158755 filed on Dec. 18, 2013, the entire contents of which application are incorporated herein for all purposes by this reference.

BACKGROUND OF INVENTION

Field of Invention

The present invention relates to a door outside handle for vehicles, and more particularly, to a technique relating to a door outside handle for vehicles capable of achieving weight reduction and cost reduction through reduction of the number of components, and capable of achieving an improvement in convenience of a work during assembly of a door handle, a handle base, and a balance weight.

Description of Related Art

A door outside handle provided in a vehicle is a handle operated by a user in order to open the door from the outside of the vehicle. As shown in FIGS. 1 and 2, the door outside handle is configured to include a handle base 1 fixedly installed in a door panel, a base lever 3 rotatably coupled to the handle base 1 via a fixed shaft 2 at one end, a door handle 4 configured so that a handle hinge 4*a* provided at one end is rotatably fitted the fixed shaft 2 and a handle lever 4*b* provided at the other end is fitted and coupled to a mounting screw 3*a* provided in the base lever 3, and a balance weight 8 which is flexibly and rotatably coupled to the handle base 1 via a balance shaft 5 and a torsion spring 6 and is installed so as to be connected to a door latch via a cable 7, thereby operating the door latch through the cable 7 while rotating around the balance shaft 5 when the base lever 3 rotates.

Accordingly, according to the structure of the related art, when a user holds and pulls the door handle 4, the door handle 4 rotates around the handle hinge 4*a* coupled to the fixed shaft 2 and simultaneously the handle lever 4*b* pulls the base lever 3, and the base lever 3 rotates the balance weight 8 while rotating around the fixed shaft 2. Thus, the cable 7 is pulled by rotation of the balance weight 8, and the door latch is operated by the pulling action of the cable 7, thereby opening the door of the vehicle.

Incidentally, the door outside handle of the related art as described above has a structure in which the balance weight 8 for operating the door latch during operation of the door handle 4 is operated through the base lever 3 rather than being directly operated, that is, a structure in which the operational force of the door handle 4 is transmitted to the balance weight 8 through the base lever 3. Accordingly, there is a disadvantage in that operational response of the balance weight 8 is delayed during operation of the door handle 4.

Further, there is also a disadvantage in that the use of the base lever 3 as described above leads to an increase in the number of components and increases in weight and cost.

Also, according to the structure of the related art, since the handle lever 4*b* provided in the door handle 4 needs to be coupled to the mounting screw 3*a* provided in the base lever 3 through a narrow working space, there is also a disadvantage in that convenience during assembly work is reduced.

The information disclosed in this Background section is only for enhancement of understanding of the general background of the invention and should not be taken as an acknowledgement or any form of suggestion that this information forms the prior art already known to a person skilled in the art.

SUMMARY OF INVENTION

The present invention has been made in an effort to solve the problems of the related art and/or other problems and is directed to provide a door outside handle for vehicle. The door outside handle for vehicle may include a door handle which has a handle hinge formed at one end and a handle lever formed at the other end and has a lever groove formed on a lower end bottom surface of the handle lever, a handle base which has a hinge hole formed at one end and a lever hole formed at the other end into which the handle hinge and the handle lever are inserted, and has two shaft coupling portions separately formed at a position corresponding to where the lever hole is formed, and a balance weight which includes a balance shaft rotatably inserted into the shaft coupling portions and has an assembly protrusion formed to be fitted to the lever groove.

The door outside handle for vehicle may further include a balance spring which is fixed to the handle base at one end and fixed to the balance shaft at the other end in a state of being fitted to the balance shaft to impart elastic resilience to rotation of the balance weight.

A locking portion bent toward the handle hinge may be formed at the lower end of the handle lever, the lever groove may be formed on the bottom surface of the locking portion, and the lever groove may be formed such that one side facing the handle hinge is blocked.

The shaft coupling portions may be formed with shaft holes into which the balance shaft is rotatably inserted, respectively, and a substantially rectangular groove configured to determine an initial coupling position of the balance shaft may be formed in a shaft hole close to the hinge hole among the shaft holes so as to be connected to the shaft holes.

In the shaft coupling portion formed with the substantially rectangular groove, a substantially circular groove for determining an initial coupling position of the balance weight together with the substantially rectangular groove may be formed.

The balance shaft may include two shafts extending to both sides based on a weight portion of the balance weight, and in any one shaft of two shafts, a substantially rectangular protrusion fitted to the substantially rectangular groove so as to be able to determine the initial coupling position of the balance shaft may be formed.

In the balance weight, a substantially circular protrusion fitted to the substantially circular groove so as to be able to determine the initial coupling position of the balance weight may be formed.

The balance spring may be installed so as to be fitted to the shaft of the two balance shafts in which the substantially rectangular protrusion is not formed.

When the handle hinge is inserted into the hinge hole and the handle lever is inserted into the lever hole in a state in which the substantially rectangular protrusion is fitted to the substantially rectangular groove and the substantially circular protrusion is fitted to the substantially circular groove, the assembly protrusion of the balance weight may be inserted into the lever groove of the door handle.

When the door handle is moved toward the shaft coupling portion in which the substantially rectangular groove is not formed in a state in which the assembly protrusion is inserted into the lever groove, the balance weight may move together by contact between the lever groove and the assembly protrusion, the substantially circular protrusions may fall out of the substantially circular groove while the substantially rectangular protrusion falls out of the substantially rectangular groove by the movement of the balance weight, and the balance weight may be elastically supported by the handle lever by elastic force of the balance spring.

According to the present invention, since it is also possible to achieve coupling between the door handle and the balance weight when assembling the door handle to the handle base, it is also possible to achieve an improvement in convenience of work during assembly of the door outside handle, further achieve an improvement in productivity, in particular, achieve the weight reduction and the cost reduction through a reduction in the number of components, and improve the operational responsiveness of the balance weight when operating the door handle, and thus there is an advantage of being able to improve the quality.

The methods and apparatuses of the present invention have other features and advantages which will be apparent from or are set forth in more detail in the accompanying drawings, which are incorporated herein, and the following Detailed Description, which together serve to explain certain principles of the present invention.

BRIEF DESCRIPTION OF THE DRAWINGS

The above and other features of the present invention will now be described in detail with reference to exemplary embodiments thereof illustrating the accompanying drawings which are given hereinbelow by way of illustration only, and thus are not limitative of the present invention, and wherein:

FIG. 1, FIG. 2A and FIG. 2B are views for explaining a door outside handle for vehicle of the related art.

FIG. 9A and FIG. 9B are views illustrating an initial coupling state of an exemplary door handle, an exemplary handle base, and an exemplary balance weight according to the present invention.

DETAILED DESCRIPTION

Figure 1:
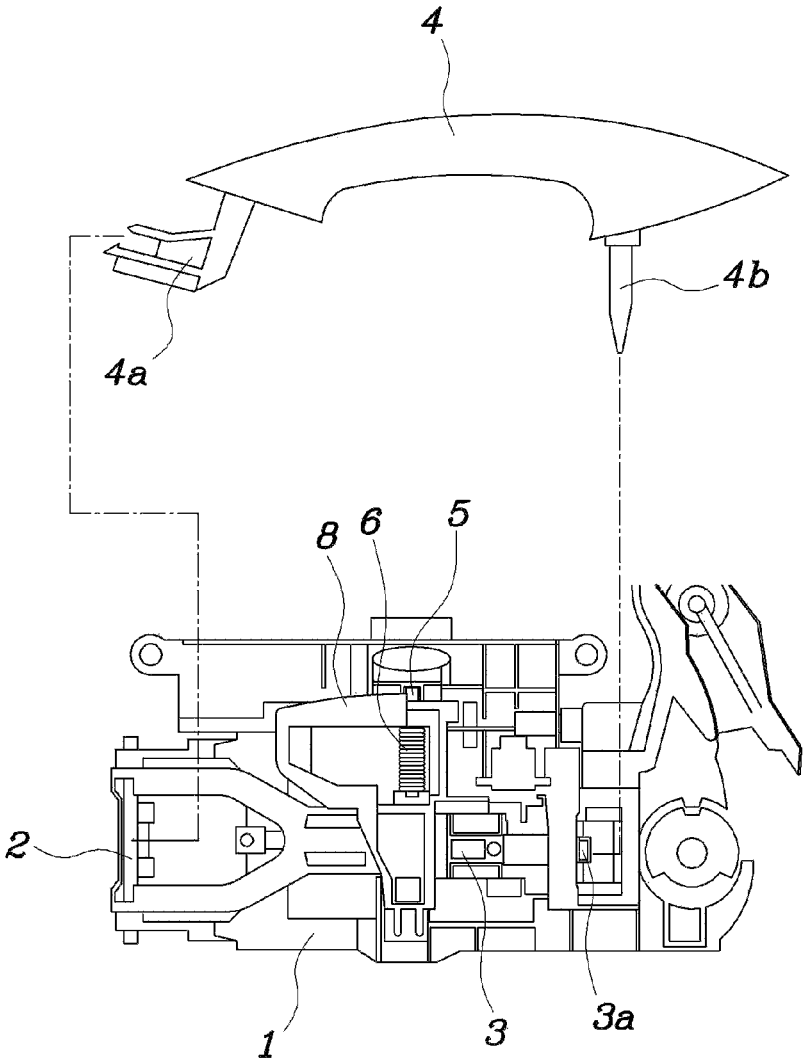
FIG. 1 (Related Art)
Figure 3:
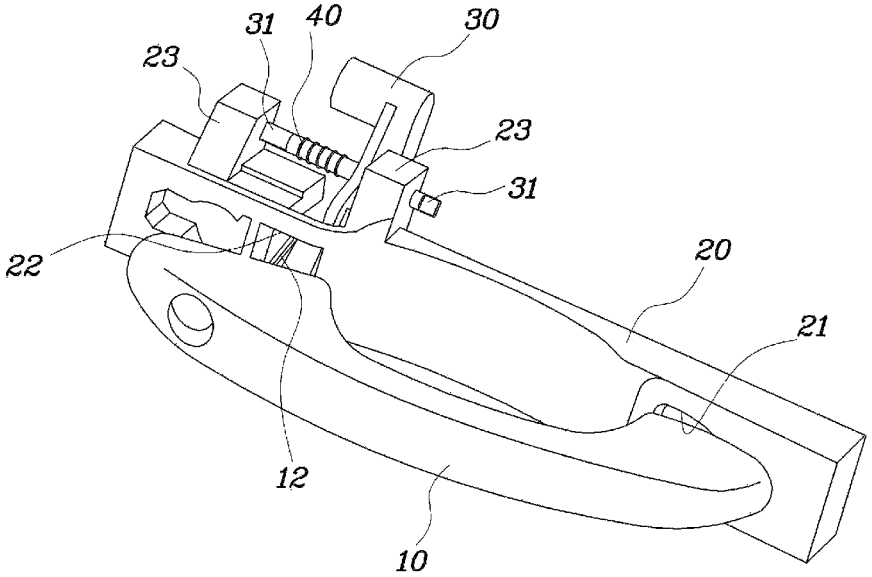
FIG. 3 is a perspective view illustrating an initial coupling state of an exemplary door outside handle for vehicle according to the present invention.
Figure 4:
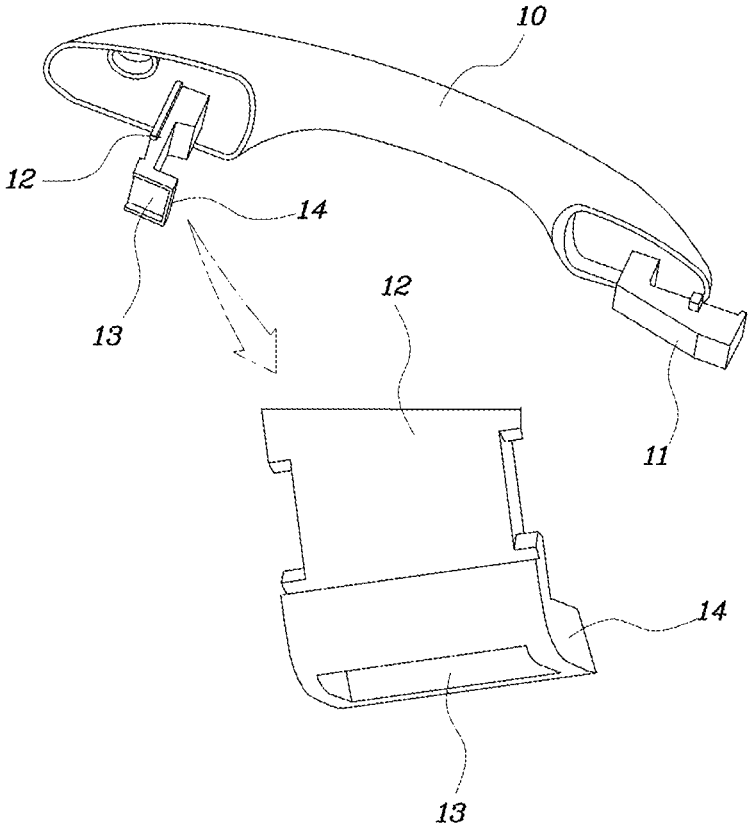
FIG. 4 is a perspective view of an exemplary handle door according to the present invention.
Figure 5:
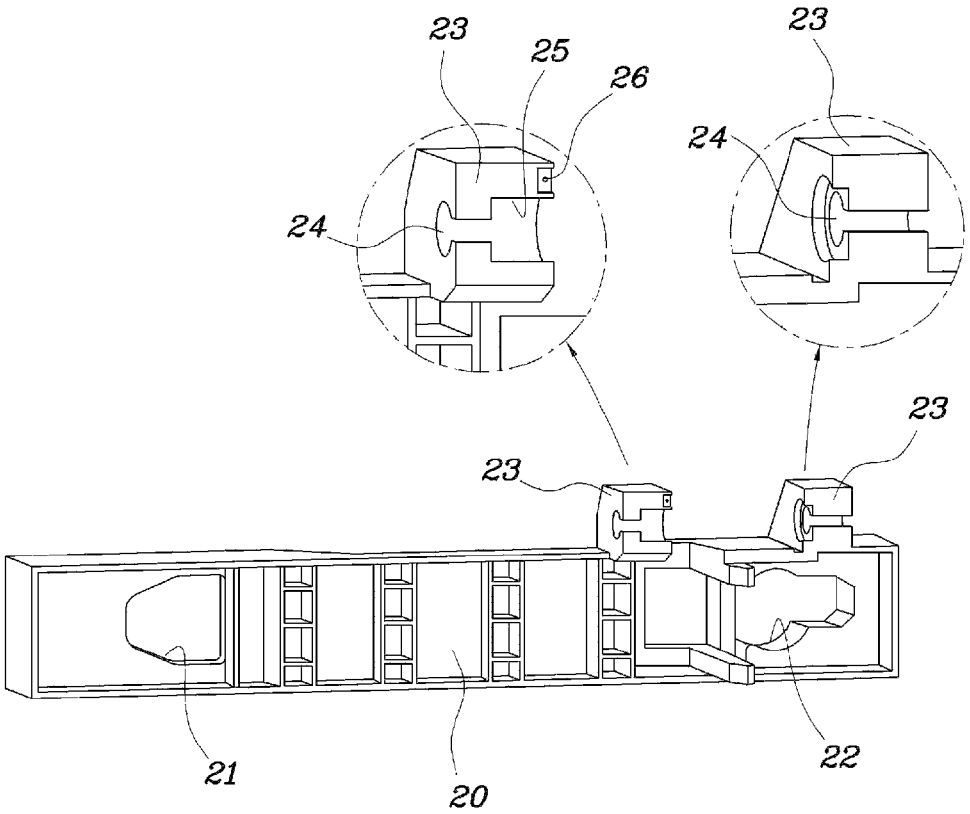
FIG. 5 is a perspective view of an exemplary handle base according to the present invention.
Figure 6:
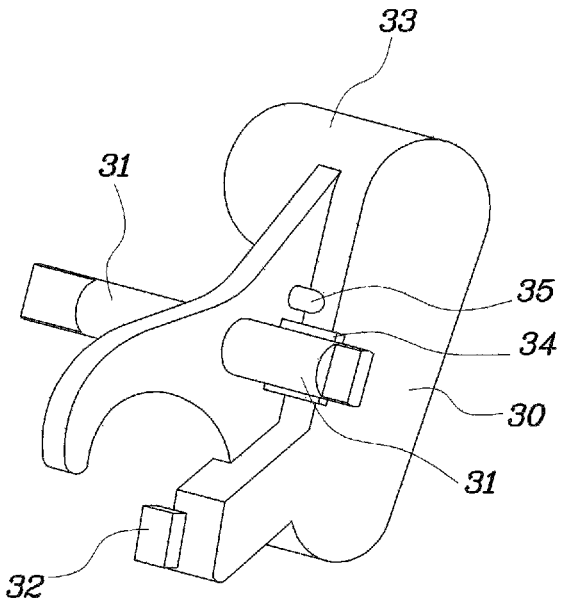
FIGS. 6 and 7 are perspective views of an exemplary balance weight according to the present invention.
Figure 7:
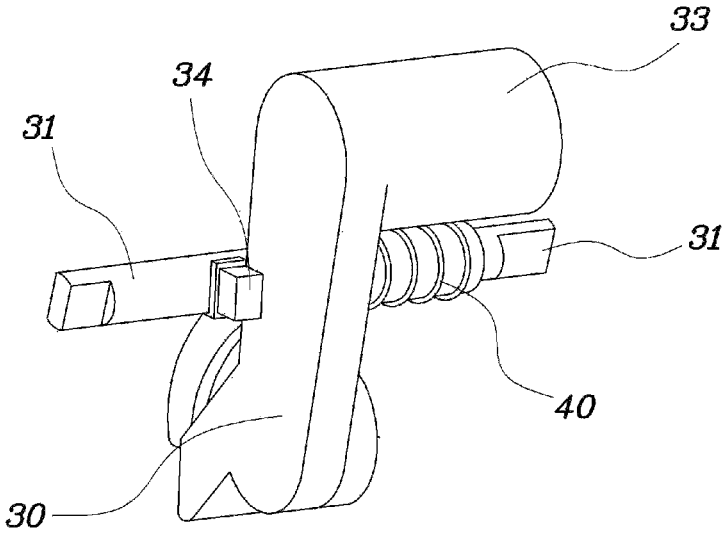

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

As shown in FIGS. 3 to 11, the door outside handle for vehicle according to the present invention is configured to include a door handle 10 which has a handle hinge 11 and a handle lever 12 formed at one end and the other end, and a lever groove 13 formed on a lower end bottom surface of the handle lever 12; a handle base 20 which has a hinge hole 21 and a lever hole 22 formed at one end and the other end into which the handle hinge 11 and the handle lever 12 are inserted, and has two shaft coupling portions 23 separately formed at a position corresponding to where the lever hole 22 is formed; and a balance weight 30 which includes a balance shaft 31 rotatably fitted to the shaft coupling portions 23 and has an assembly protrusion 32 fitted to the lever groove 13.

Also, the present invention further includes a balance spring 40 which is fixed to the handle base 20 at one end and fixed to the balance shaft 31 at the other end in a form of being fitted to the balance shaft 31, thereby imparting elastic resilience to rotation of the balance weight 30.

Meanwhile, at a lower end of the handle lever 12 in the door handle 10, a locking portion 14 bent toward the handle hinge 11 is formed, the lever groove 13 is formed on the bottom surface of the locking portion 14, and the lever groove 13 has a structure which is formed so that one side facing the handle hinge 11 is blocked.

Further, in the shaft coupling portions 23 of the handle base 20, cylindrical shaft holes 24 to which the balance shaft 31 is rotatably fitted are formed, respectively, and, in the shaft hole 24 close to the shaft hole 21 of the hinge holes 24 a rectangular or substantially rectangular groove 25 for determining an initial coupling position of the first balance shaft 31 is formed so as to be connected to the shaft holes 24.

Also, the balance shaft 31 is constituted by two shafts extending to both sides based on the weight portion 33 of the balance weight 30, and in any one shaft of the two shafts, a rectangular or substantially rectangular protrusion 34 fitted to the rectangular groove 25 of the shaft coupling portion 23 so as to be able to determine the initial position of the balance shaft 31 is formed.

That is, since the rectangular protrusion 34 of the balance shaft 31 is fitted to the rectangular groove 25 when the balance weight 30 is initially coupled to the handle base 20, the initial coupling position of the balance shaft 31 is determined, and thus, it is possible to prevent the rotation of the balance weight 30 until handle base 10 is coupled to the door handle 20.

Moreover, when the rectangular protrusion 34 of the balance shaft 31 is in a state of being fitted to the rectangular groove 23 of the shaft coupling portion 23, the balance spring 40 enters a compressed state and thus accumulates elastic force.

Furthermore, in any one shaft coupling portion 23 of the handle base 20 formed with the rectangular groove 25, a circular or substantially circular groove 26 for determining the initial coupling position of the balance weight 30 together with the rectangular groove 25 is formed, and the balance weight 30 is formed with a circular or substantially circular protrusion 35 fitted to the circular groove 26.

The balance spring 40 has a structure fitted to any one shaft of the two balance shafts in which the rectangular protrusion 34 is not formed.

According to the present invention, the handle hinge 11 of the door handle 10 is inserted into the hinge hole 21 of the handle base 20 and the handle layer 12 is inserted into the lever hole 22 in a state in which the rectangular protrusion 34 of the balance weight 30 is fitted to the rectangular groove 25 of the handle base 20 and the circular protrusion 35 is fitted to the circular groove 26, thereby obtaining a structure in which the assembly protrusion 32 of the balance weight 30 is inserted into the lever groove 13 of the door handle 10.

Moreover, when the door handle 10 is moved toward the shaft coupling portion 23 of one side which the rectangular groove 25 is not formed in a state in which the assembly protrusion 32 is inserted into the lever groove 13, the balance weight 30 is also moved by the contact between the lever groove 13 and the assembly protrusion 32, the circular protrusion 35 falls out of the circular groove 26 while the rectangular protrusion 34 falls out of the rectangular groove 25, and at the same time, the balance weight 30 is elastically supported by the handle lever 12 while rotating around the balance shaft 31 by resilience of the balance spring 40 that accumulated the elastic force.

An operation of the embodiment of the present invention will be described hereinafter.

Figure 8:
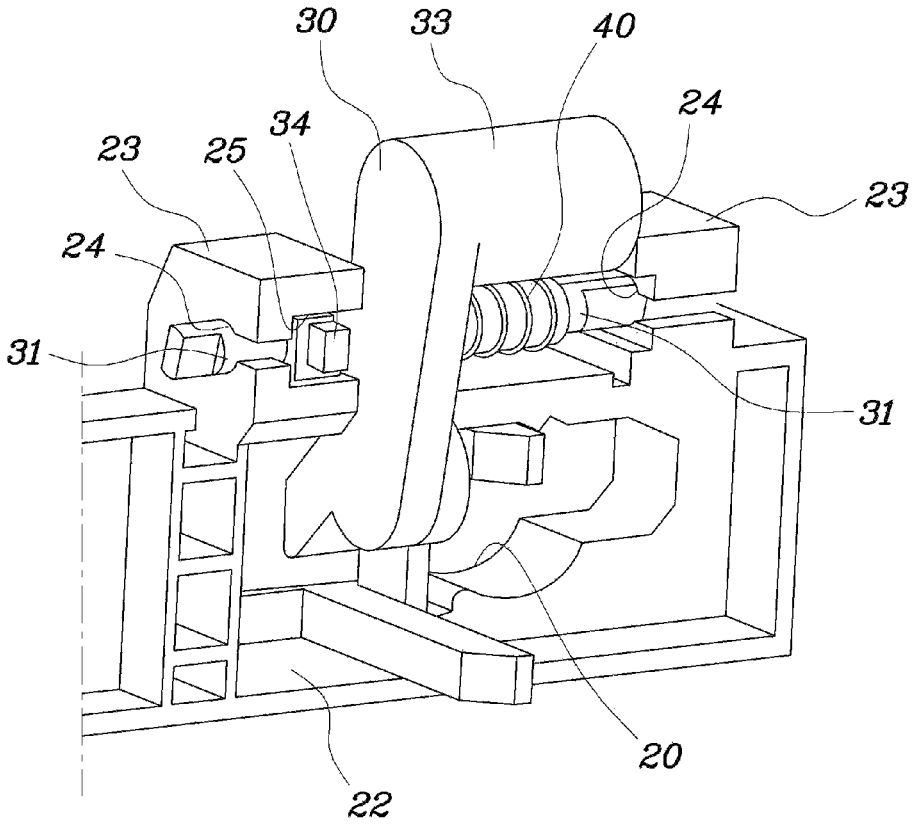
FIG. 8 is a view illustrating an initial coupling state of an exemplary handle base and an exemplary balance weight according to the present invention.

First, as shown in FIG. 8, the balance weight 30 is assembled to the handle base 20 so that the balance shaft 31 is inserted into the shaft hole 24 of the shaft coupling portion 23. At this time, an initial coupling position of the balance shaft 31 is determined by fitting the rectangular protrusion 34 of the balance shaft 31 to the rectangular groove 25 of the shaft coupling portion 23, and an initial coupling position of the balance weight 30 is simultaneously determined by fitting the circular protrusion 35 of the balance weight 30 to the circular groove 26 of the shaft coupling portion 23.

When the initial coupling position is set in a state in which the rectangular protrusion 34 of the balance shaft 31 is fitted to the rectangular groove 25 of the shaft coupling portion 23 as described above, the balance spring 40 at this time enters a compressed state, and thus accumulates elastic force.

When assembling of the balance weight 30 to the handle base 20 is completed, the handle door 10 is assembled to the handle base 20. That is, when the handle hinge 11 of the door handle 10 is inserted into the hinge hole 21 of the handle base 20 and then the handle lever 12 of the door handle 10 is inserted into the lever hole 22 of the handle base 20 as shown in FIG. 9, the assembly protrusion 32 of the balance weight 30 is inserted into the lever groove 13 of the door handle 10.

Moreover, when the door handle 10 is held and moved by pulling it in a direction of an arrow M1 of FIG. 9 in a state in which the assembly protrusion 32 is inserted into the lever groove 13 as shown in FIG. 9, the balance weight 30 also moves in the same direction as the door handle 10 by the contact between the lever groove 13 and the assembly protrusion 32.

Figure 10:
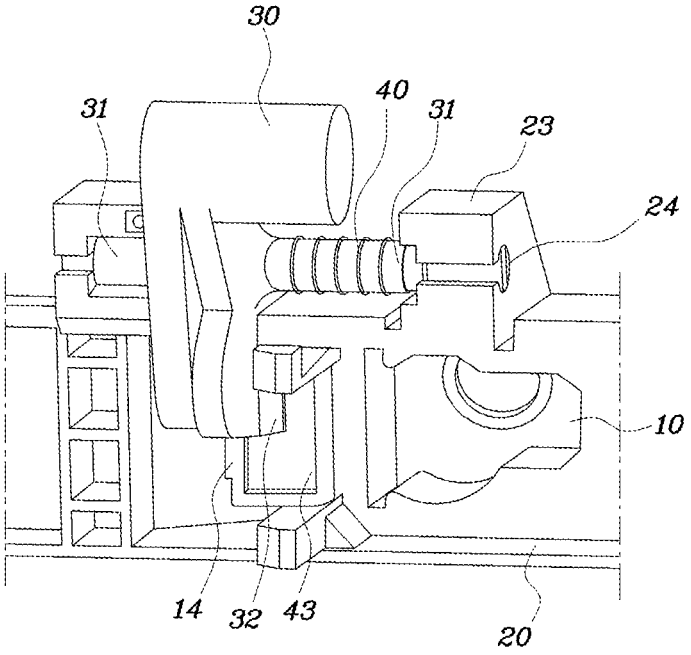
FIGS. 10 and 11 are views illustrating a final coupling state of an exemplary door handle, an exemplary handle base, and an exemplary balance weight according to the present invention.
Figure 11:
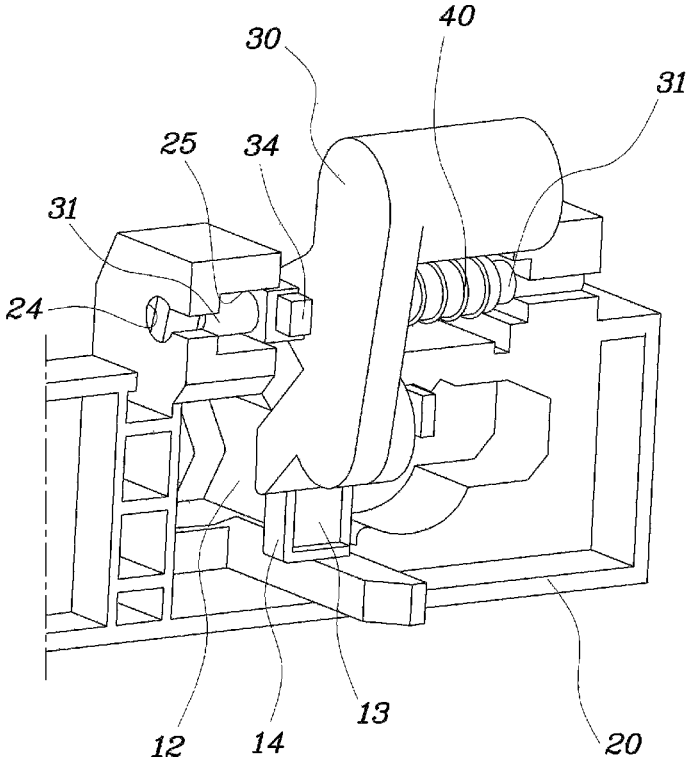

As shown in FIGS. 10 and 11, the balance shaft 31 also moves by the movement of the balance weight 30 as described above, at this time, the rectangular protrusion 34 of the balance shaft 31 falls out of the rectangular groove 25 of the shaft coupling portion 23, and the circular protrusion 35 of the balance weight 30 simultaneously falls out of the circular groove 26 of the shaft coupling portion 23. Form this time, the balance weight 30 is in a state of freely pivoting around the balance shaft 31 fitted to the shaft hole 24.

Furthermore, when the rectangular protrusion 34 of the balance shaft 31 falls out of the rectangular groove 25 of the shaft coupling portion 23, at the same time, the balance weight 30 pivots by receiving the elastic force accumulated from the balance spring 40 by restoration of the balance spring 40 which was in a compressed state, whereby the balance weight 30 enters a state of being elastically supported by the handle lever 12 of the door handle 10, thereby completing the assembly work of the door handle 10, the handle base 20, and the balance weight 30.

Accordingly, when a user holds and pulls the door handle 10, a part with the handle lever 12 is pulled while rotating around the handle hinge 11, the balance weight 30 pivots around the balance shaft 31 by pulling of the door handle 10, a cable connected to the balance weight 30 is pulled by rotation of the balance weight 30, a door latch is activated by pulling action of the cable, and thus, the vehicle door is opened.

As described above, various embodiments according to the present invention have a configuration in which the door handle 10 and the balance weight 30 are directly connected to each other, and thus, the balance weight 30 for operating the door latch is immediately operated during operation of the door handle 10. Accordingly, there is an advantage in that it is possible to improve the operation responsiveness of the balance weight 30 during the operation of door handle 10, thereby improving the quality.

Further, since the present invention has a configuration which can get rid of the use of a base lever which operates in conjunction with the door handle as in the related art, there is also an advantage in that it is possible to achieve reduction of the number of the components, cost reduction and weight reduction.

Further, the present invention has a configuration which is also capable of achieving coupling between the door handle 10 and the balance weight 30 when assembling the door handle 10 to the handle base 20. Accordingly, there is also an advantage in that it is possible to achieve an improvement in convenience of work during assembly of the door outside handle, thereby improving the productivity.

For convenience in explanation and accurate definition in the appended claims, the terms "upper" or "lower", and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A door outside handle for vehicle, comprising:

a door handle having a handle hinge formed at a first end of the door handle;

a handle lever formed at a second end of the door handle;

a lever groove formed on a lower end bottom surface of the handle lever;

a handle base including:

a hinge hole formed at a first end of the handle base, wherein the handle lever is inserted into the hinge hole;

a lever hole formed at a second end of the handle base, wherein the handle lever is inserted into the lever hole; and two shaft coupling portions separately formed at a position of the handle base, corresponding to where the lever hole is formed;

a balance weight including:

a balance shaft rotatably inserted into the shaft coupling portions; and an assembly protrusion formed to be fitted to the lever groove, wherein the assembly protrusion is integrally formed on an end portion of the balance weight and protrudes in a direction perpendicular to a rotation direction of the balance weight; and a balance spring fixed to the handle base at a first end of the balance spring and fixed to the balance shaft at a second end of the balance spring in a state of being fitted to the balance shaft to impart elastic resilience to rotation of the balance weight, wherein the shaft coupling portions are formed with shaft holes into which the balance shaft is rotatably inserted, respectively, and a substantially rectangular groove configured to determine an initial coupling position of the balance shaft is formed in a shaft hole close to the hinge hole among the shaft holes so as to be connected to the shaft holes, wherein in the shaft coupling portion formed with the substantially rectangular groove, a substantially circular groove configured to determine an initial coupling position of the balance weight together with the substantially rectangular groove is formed, wherein the balance shaft includes two shafts extending to both sides based on a weight portion of the balance weight, and in at least one shaft of the two shafts, a substantially rectangular protrusion fitted to the substantially rectangular groove so as to be able to determine the initial coupling position of the balance shaft is formed, wherein when the handle hinge is inserted into the hinge hole and the handle lever is inserted into the lever hole in a state in which the substantially rectangular protrusion is fitted to the substantially rectangular groove and the substantially circular protrusion is fitted to the substantially circular groove, the assembly protrusion of the balance weight is inserted into the lever groove of the door handle, and wherein:

when the door handle is moved toward the shaft coupling portion in which the substantially rectangular groove is not formed in a state in which the assembly protrusion is inserted into the lever groove, the balance weight moves together by contact between the lever groove and the assembly protrusion;

the substantially circular protrusion falls out of the substantially circular groove while the substantially rectangular protrusion falls out of the substantially rectangular groove by the movement of the balance weight; and the balance weight is elastically supported by the handle lever by elastic force of the balance spring.

2. The door outside handle for vehicle of claim 1, wherein a locking portion bent toward the handle hinge is formed at a lower end of the handle lever;

the lever groove is formed on a bottom surface of the locking portion; and the lever groove is formed such that one side facing the handle hinge is blocked.

3. The door outside handle for vehicle of claim 1, wherein in the balance weight, the substantially circular protrusion fitted to the substantially circular groove so as to be able to determine the initial coupling position of the balance weight is formed.

4. The door outside handle for vehicle of claim 1, wherein the balance spring is installed so as to be fitted to the shaft of the two balance shafts in which the substantially rectangular protrusion is not formed.

* * * * *